US011450994B2

(12) United States Patent
Brasse et al.

(10) Patent No.: US 11,450,994 B2
(45) Date of Patent: Sep. 20, 2022

(54) PLUG CONNECTION HAVING REDUNDANCY AND VEHICLE HAVING SUCH A CONNECTION

(71) Applicant: Bayerische Motoren Werke Aktiengesellschaft, Munich (DE)

(72) Inventors: Matthias Brasse, Vaterstetten (DE); Joachim Froeschl, Herrsching (DE); Juergen Gebert, Moosburg (DE); Johannes Meisenzahl, Allershausen (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 77 days.

(21) Appl. No.: 16/972,390

(22) PCT Filed: Sep. 13, 2019

(86) PCT No.: PCT/EP2019/074575
§ 371 (c)(1),
(2) Date: Dec. 4, 2020

(87) PCT Pub. No.: WO2020/058138
PCT Pub. Date: Mar. 26, 2020

(65) Prior Publication Data

US 2021/0234318 A1 Jul. 29, 2021

(30) Foreign Application Priority Data

Sep. 18, 2018 (DE) ..... 10 2018 215 879.7

(51) Int. Cl.
*H01H 37/32* (2006.01)
*H01R 13/71* (2006.01)
(Continued)

(52) U.S. Cl.
CPC ..... *H01R 13/71* (2013.01); *H01H 37/32* (2013.01); *H01R 4/01* (2013.01); *H01R 13/26* (2013.01)

(58) Field of Classification Search
CPC ..... H01R 13/71; H01R 4/01; H01R 13/26; H01H 37/32
See application file for complete search history.

(56) References Cited

U.S. PATENT DOCUMENTS 4,498,726 A * 2/1985 Mattis ..... H01R 33/18 439/736
10,348,000 B2 * 7/2019 Fischer ..... H01H 71/16
(Continued)

FOREIGN PATENT DOCUMENTS

CN 103855553 A 6/2014
JP 63-211583 A 9/1988
(Continued)

OTHER PUBLICATIONS

International Search Report (PCT/ISA/210) issued in PCT Application No. PCT/EP2019/074575 dated Dec. 5, 2019 with English translation (four (4) pages).
(Continued)

*Primary Examiner* — Stephen S Sul
(74) *Attorney, Agent, or Firm* — Crowell & Moring LLP

(57) ABSTRACT

A plug connection has a plug socket and a plug which can be releasably inserted therein, as well as a plurality of electrically conductive contact areas and spring contacts. The spring contacts are divided into a first group and a second group. In a first state, the spring contacts of the first group are in contact with their associated contact areas and the spring contacts of the second groups rest on at least one stop and are not in contact with their associated contact areas. A trigger causes the spring contacts of the second group to overcome the at least one stop when a defined
(Continued)

temperature is exceeded so as to come into contact with their associated contact areas in a second state.

9 Claims, 3 Drawing Sheets

(51) Int. Cl.
*H01R 4/01* (2006.01)
*H01R 13/26* (2006.01)

(56) References Cited

U.S. PATENT DOCUMENTS

2015/0064959 A1* 3/2015 Wang ..... H01R 13/68
439/366
2015/0333457 A1* 11/2015 Liu ..... H01R 13/7037
335/208

FOREIGN PATENT DOCUMENTS

JP 2001-345152 A 12/2001
JP 2014-154333 A 8/2014

OTHER PUBLICATIONS

German-language Written Opinion (PCT/ISA/237) issued in PCT Application No. PCT/EP2019/074575 dated Dec. 5, 2019 (nine (9) pages).
German-language Search Report issued in German Application No. 10 2018 215 879.7 dated Sep. 8, 2019 with partial English translation (11 pages).

* cited by examiner

PLUG CONNECTION HAVING REDUNDANCY AND VEHICLE HAVING SUCH A CONNECTION

BACKGROUND AND SUMMARY OF THE INVENTION

The invention relates to a plug connection having a redundancy function and a vehicle having such a plug connection.

Plug connections, as illustrated in FIG. 1 for example, are known from the prior art. The plug connection 1 has a plug socket 2 and a plug 3 which can be inserted therein. The plug socket 2 comprises contact areas 4 with which a spring contact 5 of the plug 3 is associated in each case. The contact areas 4 are electrically conductively connected to wires 6 of a cable 7 and the spring contacts 5 are electrically conductively connected to wires 8 of a cable 9.

In such plug connections, wear of the contact points can occur over the useful life. More precisely, the contact points can become worn as a result of micro movements. Depending on the material used, this can result in friction corrosion at the contact points, which can lead to the deterioration of the electrical contact and a greater contact resistance. This can result in the plug connection becoming heated, starting from the contact point. This could lead to the plug connection having to be replaced.

An object of the present invention is therefore to at least partially eliminate the above-mentioned disadvantages. This object is achieved by a plug connection, and by and a motor vehicle having such a plug connection, in accordance with the independent claims. Advantageous further developments of the invention are the subject-matter of the dependent claims.

According to an exemplary embodiment of the invention, a plug connection is provided, having a plug socket and a plug which is releasably inserted therein; one or more electrically conductive contact areas, and a plurality of electrically conductive spring contacts, wherein at least one spring contact is associated with each contact area and the spring contacts are divided into at least a first and second group, wherein, in a first state, the spring contacts of the first group are in contact with their associated contact areas and the spring contacts of the second groups abut against at least one stop and are not in contact with their associated contact areas; a trigger, which, when a certain temperature is exceeded, induce the spring contacts of the second group to overcome the at least one stop and, in a second state, to come into contact with their associated contact areas. In particular, the spring contacts of the first group are free of the trigger. This has the advantage that the plug connection, upon overheating for the first time, activates a redundancy function with the spring contacts of the second group, in which the spring contacts of the second group take over the function of the spring contacts of the first group so that the useful life of the plug connection is significantly increased, in particular doubled, and the functionality of the plug connection is ensured.

According to a further exemplary embodiment of the invention, the certain temperature is a temperature above a normal operating temperature. The normal operating temperature depends on the materials used, wherein the temperature to which a certain plug connection can be safely used with the materials used is clear to the person skilled in the art. For example, the certain temperature can be 130° C. in the case of tin-plated contact areas and 150° C. in the case of silver-plated contact areas. It could, however, also be 100° C., 110° C., 120° C. or another suitable temperature.

According to a further exemplary embodiment of the invention, the trigger comprises a bimetal.

According to a further exemplary embodiment of the invention, the trigger, when the certain temperature is exceeded, applies a force to the spring contacts of the second group, which urges these towards the respectively associated contact areas.

According to a further exemplary embodiment of the invention, the triggers are a plurality of bimetal strips, of which one in each case is associated with a spring contact of the second group and is arranged in each case on the side of the spring contact which is remote from the contact area.

According to a further exemplary embodiment of the invention, the trigger, when the certain temperature is exceeded, applies a force to the at least one stop, which urge this away from the spring contacts.

According to a further exemplary embodiment of the invention, the stops are formed in one piece, in particular monolithically, with the respective contact areas.

According to a further exemplary embodiment of the invention, the first state is a state between a new state of the plug connection and a state until the certain temperature is reached and the second state is a state once the certain temperature is exceeded.

According to a further exemplary embodiment of the invention, the plug connection furthermore has detection sensor with which it can be determined whether the plug connection is in the second state. It can therefore be established and relayed to a control device or vehicle control device that the redundancy function is already activated so that the affected plug connection can potentially be replaced during a future vehicle service.

The present invention moreover provides a motor vehicle having such a plug connection.

Preferred exemplary embodiments of the present invention are described below with reference to the accompanying drawings.

DETAILED DESCRIPTION OF THE DRAWINGS

Figure 1:
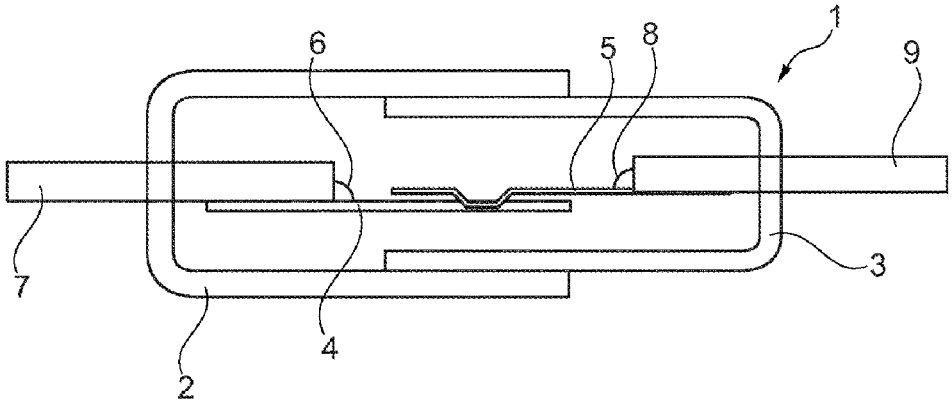
Fig. 1 (Prior art)
FIG. 1 is a schematic representation of a plug connection of the prior art.
Figure 2A:
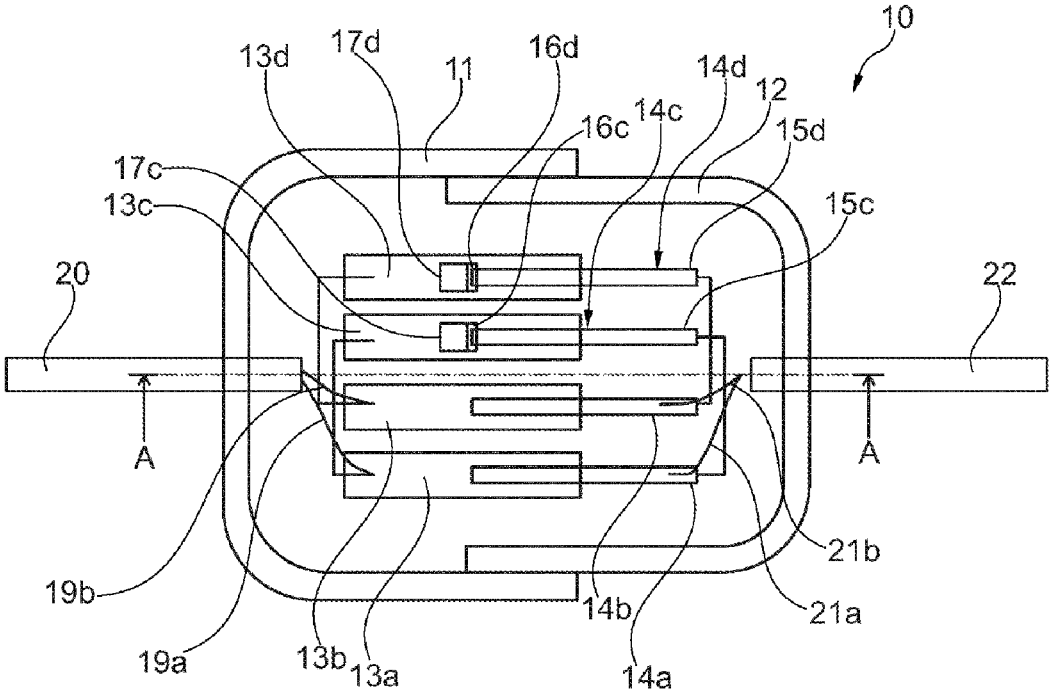
FIG. 2*a* is a schematic representation of a plan view of a plug connection according to a first exemplary embodiment of the invention.
Figure 2B:
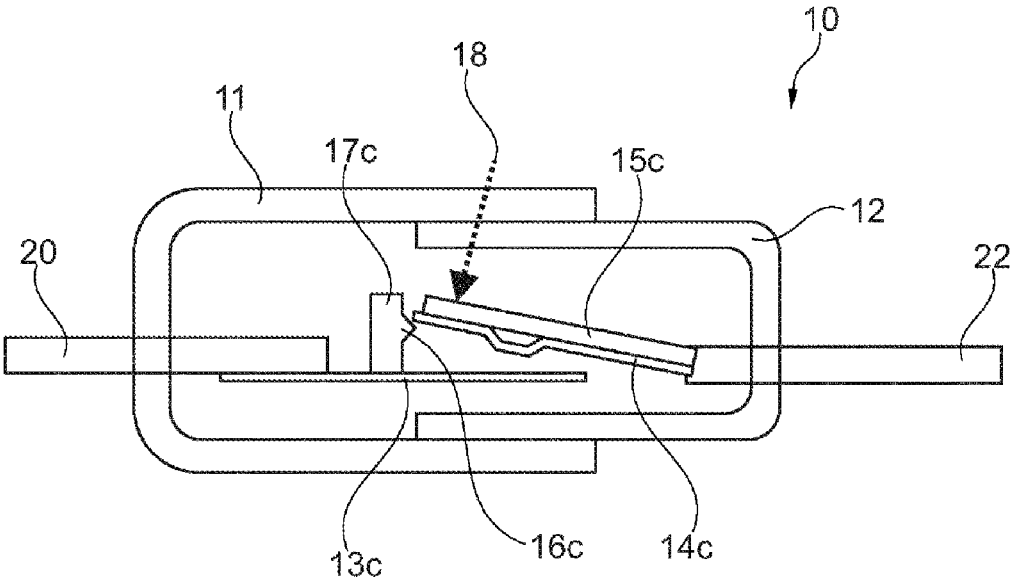
FIG. 2*b* is a schematic representation of a side view of the plug connection of FIG. 2*a*, cut along the section line A-A in a state before a redundancy function is activated.
Figure 2C:
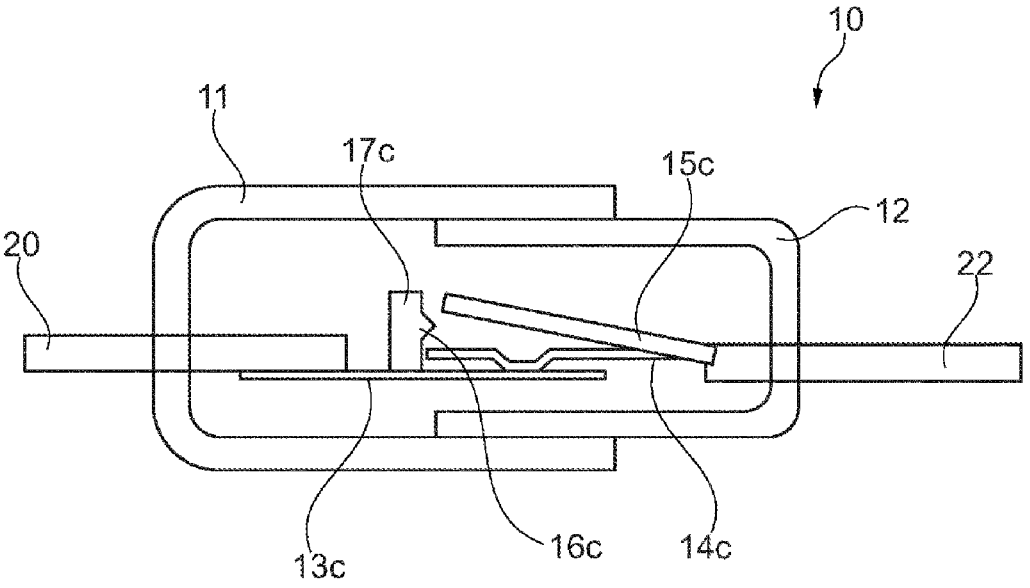
FIG. 2*c* is a schematic representation of the section of FIG. 2*b* in a state after the redundancy function is activated.

FIGS. 2*a* to 2*c* show a schematic representation of a plug connection 10 according to a first exemplary embodiment of the invention. In this case, FIG. 2*a* is a schematic plan view, FIG. 2*b* a schematic side view along a section line A-A (FIG. 2*a*) before a redundancy function is activated, and FIG. 2*c* a schematic side view along a section line A-A (FIG. 2*a*) after a redundancy function is activated.

The plug connection 10 has a plug socket 11 and a plug 12 which can be inserted into this plug socket. The plug 12 and the plug socket 11 are matched to one another such that the plug 12 can be releasably inserted into the plug socket 11 and is held in position in the plug socket 11 in the inserted state. In this case, FIGS. 2*a* to 2*c* show a fully inserted state of the plug 12.

The plug connection 10 furthermore comprises a plurality of electrically conductive contact areas (facings) 13*a*-13*d*, for example in the form of elongated flat strips. Moreover, the plug connection 10 has spring contacts 14*a*-14*d*, which are associated with the contact areas 13*a*-13*d*. The spring contacts 14*a*-14*d* are, for example, in the form of elongated flat strips with a portion which bulges towards the contact areas 14*a*-14*d*. In this case, it is possible that a separate contact area is associated with one spring contact in each case or a plurality of spring contacts are associated with a contact area, as will be explained more precisely below. The contact areas 13*a*-13*d* and the spring contacts 14*a*-14*d* are made from an electrically conductive material, preferably a metal, for example from copper with a silver coating, a tin coating or gold coating. They can be made entirely from such a material or only in certain sections. Moreover, the contact areas 13*a*-13*d* can be made from the same material as the spring contacts 14*a*-14*d* or a different material.

The spring contacts 14*a*-14*d* are divided into a plurality of groups—two groups in the exemplary embodiment described here. The spring contacts 14*a* and 14*b* of a first group are designed such that, in particular in a new state of the plug connection 10, they are in electrical contact with the respectively associated contact areas 13*a* and 13*b* in the inserted state of the plug 12. More precisely, the spring contact 14*a* is pre-tensioned such that, in this state, it is pressed onto the contact area 13*a* and an electrical connection is established between these components. Analogously, the spring contact 14*b* is pre-tensioned such that, in this state, it is likewise pressed onto the contact area 13*b*.

Should the electrical contact between a spring contact 14*a*, 14*b* of the first group and its associated contact area 13*a*, 13*b* deteriorate over the useful life of the electrical contact, for example due to oxidation of the contact point, such that overheating of the plug connection 10 occurs as a result of increased contact resistances, then spring contacts 14*c* and 14*d* of the second group are activated and therefore form a redundancy function. Overheating of the plug connection 10 is then associated with a certain temperature or first threshold temperature being exceeded. This depends on the materials used in the plug connection 10 and their temperature resistance. For example, the certain temperature can be 130° C. in the case of tin-plated contact areas and 150° C. in the case of silver-plated contact areas. However, 100° C., 110° C., 120° C. or another suitable temperature could also be selected as the first threshold temperature. Such activation of the spring contacts 14*c* and 14*d* of the second group or this redundancy function is described below.

In contrast to the spring contacts 14*a*, 14*b* of the first group, the spring contacts 14*c*, 14*d* of the second group are additionally provided with triggers 15*c*, 15*d*. In the illustrated exemplary embodiment, the triggers 15*c*, 15*d* are bimetal strips, of which one in each case is arranged on the side of the spring contacts 14*c* and 14*d* which is remote from the associated contact area 13*c*, 13*d*. The bimetal strips abut against the spring contacts 14*c*, 14*d*. Moreover, stops 16*c*, 16*d* are provided, against which the spring contacts 14*c*, 14*d* abut. The stops 16*c*, 16*d* are, for example, projections of pins or blocks 17*c*, 17*d* which are fixedly connected to the contact areas 13*c*, 13*d* (e.g. by welding, adhesion or screwing) or are formed in one piece therewith. The spring contacts 14*c*, 14*d* abut against the stops 16*c*, 16*d* such that the spring contacts 14*c*, 14*d* of the second group do not come into contact with their associated contact areas 13*c*, 13*d*. This state is illustrated in FIG. 2*b*. This means that, before and until the activation of the spring contacts 14*c*, 14*d* of the second group, the spring contacts 14*c*, 14*d* are pre-tensioned and abut against the stops 16*c*, 16*d*; however, the pre-tension is insufficient to overcome the stops 16*c*, 16*d*. This means that the spring contacts 14*c*, 14*d*, in a first state, which is a state from a new state until the certain temperature is first exceeded, are at a spacing from the contact areas 13*c*, 13*d*, abutting against the stops 16*c*, 16*d*. The bimetal strips exert a temperature-dependent force 18 on the spring contacts 14*c*, 14*d*. To this end, the bimetal strips are aligned so that, as the temperature increases, the center of the bimetal strips bulges in the direction away from the contact areas 13*c*, 13*d* and the ends of the bimetal strips are urged in the direction towards the contact areas 13*c*, 13*d*. Since only one end of the bimetal strips is free, this, in particular, is curved towards the contact areas 13*c*, 13*d* and exerts the force 18 on the contact springs 14*c*, 14*d*. If the certain temperature is exceeded, then the force 18 reaches a value which, together with the pre-tension of the contact springs 14*c*, 14*d*, is sufficient for the spring contacts 14*c*, 14*d* to overcome the stops 16*c*, 16*d* and come into contact with the contact areas 13*c*, 13*d*. The pre-tension of the spring contacts 14*c*, 14*d* ensures that good electrical contact with the contact areas 13*c*, 13*d* is maintained. After such an activation, the spring contacts 14*c*, 14*d* remain permanently in this activated state, i.e. in contact with the contact areas 13*c*, 13*d*. As a result of this activation, the spring contacts 14*c*, 14*d* of the second group and the contact areas 13*c*, 13*d* of the second group take over the function of the spring contacts 14*a*, 14*b* of the first group and the contact areas 13*a*, 13*b* of the first group, which represents a redundancy function.

For example, a wire 19*a* of a first cable 20 is electrically connected to the contact area 13*a* and this is electrically connected to the contact area 13*c* via a cable bridge, a conductor path or the like. Analogously, a wire 19*b* of the first cable 20 is electrically connected to the contact area 13*b* and this is electrically connected to the contact area 13*d* via a cable bridge, a conductor path or the like. A wire 21*a* of a second cable 22 is electrically connected to the spring contact 14*a*, for example, and this is electrically connected to the spring contact 14*c* via a cable bridge, a conductor path or the like. Analogously, a wire 21*b* of the second cable 22 is electrically connected to the spring contact 14*b* and this is electrically connected to the spring contact 14*d* via a cable bridge, a conductor path or the like.

The combination of the spring contact 14*c* of the second group and the contact area 13*c* is therefore arranged electrically parallel to the combination of the spring contact 14*a* of the first group and the contact area 13*a* and takes over the function thereof after the activation of the redundancy function. The useful life of the plug connection can therefore be significantly increased.

FIG. 2*c* shows the section of FIG. 2*b* schematically in a state after the activation of the redundancy function. As illustrated, the spring contact 14*c* has overcome the stop 16*c* and is pressed against the contact area 13*c* as a result of its pre-tension. Due to the activation of this redundancy function and the associated re-establishment of a good electrical connection, the temperature of the plug connection drops again and the bimetal strip can move back into its starting position, as illustrated in FIG. 2*c*.

An exemplary embodiment in which a separate contact area 13*a*-13*d* is associated with each spring contact 14*a*-14*d* was described above. The mutually electrically parallel-switched contact areas 13*a*-13*d* are then electrically connected by means of cable bridges, conductor paths or the like. However, it is also possible that only one contact area is provided instead of the respective parallel-switched contact areas. For the example in FIGS. 2*a* to 2*c*, this would mean that only one contact area is provided instead of the contact areas 13*a* and 13*c* and, likewise, only one contact area is provided instead of the contact areas 13*b* and 13*d*. The sequence of the spring contacts 14*a*-14*d* would have to be adapted accordingly.

An exemplary embodiment in which the spring contacts were divided into two groups was furthermore described above. However, it is also possible that even more spring contacts are provided, which are divided into more than two groups. For example, spring contacts of a third group could be provided, with which stops and triggers are likewise associated, wherein the spring contacts of the third group are activated at a second threshold temperature which is somewhat higher (e.g. 5%) than the first threshold temperature. The result of this would be that, when the plug connection first overheats, the spring contacts of the first group are activated and the temperature of the plug connection drops again. Should the spring contacts of the second group also deteriorate over the useful life and overheating occur again, then the spring contacts of the third group would be activated upon a second overheating, etc.

Moreover, an exemplary embodiment in which the plug socket 11 is provided with the contact areas 13*a*-13*d* and the plug 12 is provided with the spring contacts 14*a*-14*d* was described above. However, it is, of course, also possible to switch the plug and the plug socket, i.e. to provide the plug socket with the spring contacts and the plug with the contact areas.

By way of example, bimetal strips as triggers were described above. However, the triggers can also be springs, for example, which are arranged on the sides of the spring contacts which are remote from the contact areas and are housed in a material which liquefies when the certain temperature is exceeded and frees the pre-tensioned springs so that these springs then urge the spring contacts towards the contact areas. Furthermore, the triggers can be rods, which are arranged on the sides of the spring contacts which are remote from the contact areas and expand when the temperature increases so that they urge the spring contacts towards the contact areas.

An exemplary embodiment in which the plug connection 10 connects two cables 20, 22 to one another was furthermore described above; however, the invention is not restricted to this. Therefore, the plug socket 11 and/or the plug 12 (and therefore analogously the contact areas 13*a*-13*d* and/or the spring contacts 14*a*-14*d*) can also be fixedly connected or fastened to a device (for example a battery, an accumulator, an electrical device, etc.), in particular fastened thereto without cables. Therefore, the contact areas 13*a*-13*d* and/or the spring contacts 14*a*-14*d* can also be connected to conductor paths, busbars, connection terminals, etc. instead of to cables or wires.

Figure 3A:
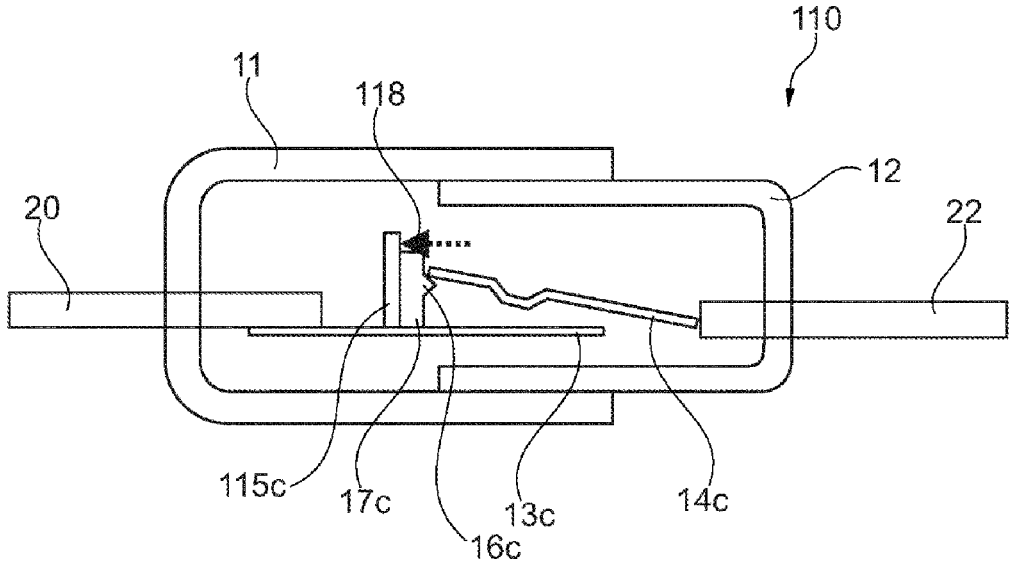
FIG. 3*a* is a schematic representation of a sectional side view of a plug connection according to a second exemplary embodiment in a state before a redundancy function is activated.

A further option in terms of how the triggers can be implemented is described in connection with FIGS. 3*a* and 3*b*. FIG. 3*a* shows a schematic sectional side view of a plug connection 110 according to a second exemplary embodiment in a state before a redundancy function is activated. To avoid repetition, the description above (including the described modifications) is also referred to in connection with this exemplary embodiment and should also apply for the following second exemplary embodiment. Therefore, only aspects which differ from this previous description are explained below.

In the second exemplary embodiment, triggers 115*c*, 115*d* are provided, which, in contrast to the first exemplary embodiment, do not act apply a force 118 to the spring contacts but to the stops 16*c*, 16*d* or the blocks 17*c*, 17*d*. As in the first exemplary embodiment the triggers 115*c*, 115*d* are bimetal strips which draw the blocks 17*c*, 17*d* away from their associated spring contacts 14*c*, 14*d* when the temperature increases, so that the pre-tension of the spring contacts 14*c*, 14*d* when the certain temperature or the first threshold temperature is exceeded is sufficient to overcome the stops 16*c*, 16*d*. The triggers 115*c*, 115*d* must be somehow connected to the blocks 17*c*, 17*d*, for example encompass these, so that a force transfer is ensured.

Figure 3B:
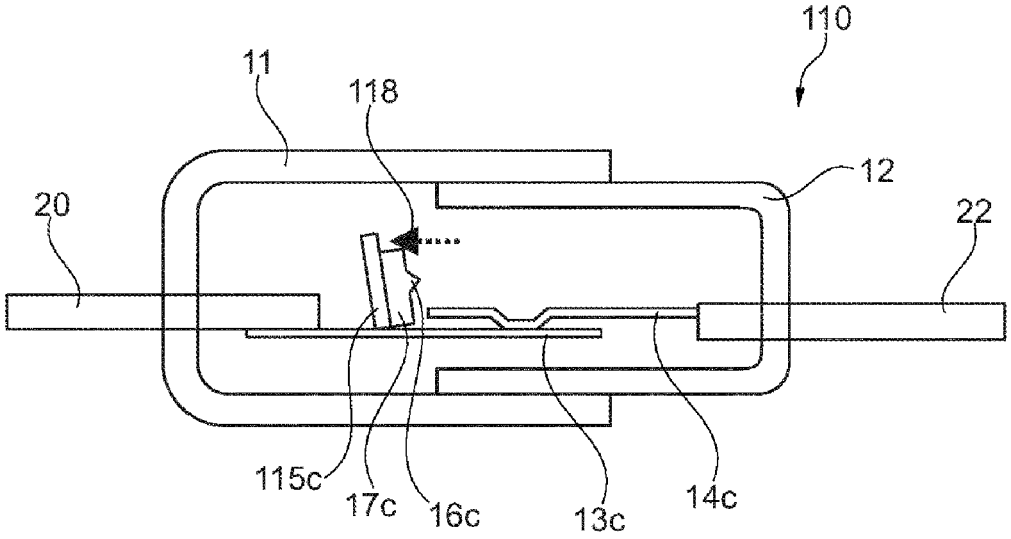
FIG. 3*b* is a schematic representation of the section of FIG. 3*a* in a state after the redundancy function is activated.

FIG. 3*b* schematically shows the section of FIG. 3*a* in a state after the redundancy function is activated and whilst the force 118 is still applied.

Whilst the invention has been illustrated and described in detail in the drawings and the description above, this illustration and description should be understood to be illustrative or exemplary and not restrictive and it is not intended that the invention be restricted to the disclosed exemplary embodiment. The simple fact that certain features are mentioned in different dependent claims shall not imply that a combination of these features could not also be advantageously used.

What is claimed is:

1. A plug connection, comprising:

a plug socket and a plug which is releasably insertable therein;

a plurality of electrically conductive contact areas; and a plurality of electrically conductive spring contacts, wherein at least one spring contact of the plurality of electrically conductive spring contacts is associated with each contact area of the plurality of electrically conductive contact areas and the plurality of electrically conductive spring contacts are divided into at least a first group and a second group, wherein, in a first state, the plurality of electrically conductive spring contacts of the first group are in contact with their associated contact areas and the plurality of electrically conductive spring contacts of the second group abut against at least one stop and are not in contact with their associated contact areas; and a trigger which, when a defined temperature is exceeded, induces the spring contacts of the second group to overcome the at least one stop and, in a second state, to come into contact with their associated contact areas.

2. The plug connection according to claim 1, wherein the defined temperature is a temperature above a normal operating temperature of the plug connection.

3. The plug connection according to claim 1, wherein the trigger comprises a bimetal.

4. The plug connection according to claim 1, wherein the trigger, when the defined temperature is exceeded, applies a force to the plurality of electrically conductive spring contacts of the second group, which urges the spring contacts of the second group towards the respectively associated contact areas of the plurality of electrically conductive contact areas.

5. The plug connection according to claim 1, wherein the trigger comprises a plurality of bimetal strips, wherein each bimetal strip is associated with a spring contact of the plurality of electrically conductive spring contacts of the second group, and wherein sides of the plurality of electrically conductive spring contacts of the second group on which the bimetal strips are arranged are remote from the associated contact areas.

6. The plug connection according to claim 1, wherein the trigger, when the certain temperature is exceeded, applies a force to the at least one stop which urges the at least one stop away from the plurality of electrically conductive spring contacts.

7. The plug connection according to claim 1, wherein the at least one stop is formed in one piece with the respective contact areas.

8. The plug connection according to claim 1, wherein the first state is a state between a new state of the plug connection and a state until the defined temperature is reached, and the second state is a state once the defined temperature is exceeded.

9. A motor vehicle comprising a plug connection according to claim 1.

* * * * *